US006505407B2

(12) United States Patent
Savage

(10) Patent No.: US 6,505,407 B2
(45) Date of Patent: Jan. 14, 2003

(54) MOVING PIN ARCHERY SIGHT

(76) Inventor: Huey Savage, 110 N. Front St., Oak Grove, LA (US) 71263

( * ) Notice: Subject to any disclaimer, the term of this patent is extended or adjusted under 35 U.S.C. 154(b) by 0 days.

(21) Appl. No.: 09/918,554

(22) Filed: Jul. 30, 2001

(65) Prior Publication Data

US 2002/0100176 A1 Aug. 1, 2002

Related U.S. Application Data

(60) Provisional application No. 60/264,405, filed on Jan. 26, 2001.

(51) Int. Cl.[7] ..... F41G 1/467
(52) U.S. Cl. ..... 33/265; 124/87
(58) Field of Search ..... 33/265, 263, 227, 33/471, 465; 124/87, 88

(56) References Cited

U.S. PATENT DOCUMENTS 761,272 A * 5/1904 Wagniere et al. ..... 33/465
2,777,204 A * 1/1957 Graves ..... 33/102
3,013,336 A * 12/1961 Pennington ..... 33/46
4,541,179 A * 9/1985 Closson ..... 124/87
4,562,649 A * 1/1986 Ciavarella ..... 33/419
5,092,052 A * 3/1992 Godsey ..... 124/87
5,465,491 A * 11/1995 Thell ..... 33/265
5,651,185 A * 7/1997 Vanderheyden et al. ..... 124/87
5,920,996 A * 7/1999 Hurckman et al. ..... 33/265
5,975,069 A * 11/1999 Hamm et al. ..... 124/87
6,079,111 A * 6/2000 Williams et al. ..... 124/87
6,119,672 A * 9/2000 Closson ..... 124/87
6,134,794 A * 10/2000 Raukola ..... 124/87

* cited by examiner

*Primary Examiner*—Diego Gutierrez
*Assistant Examiner*—Eric H Linn, Jr.
(74) *Attorney, Agent, or Firm*—Joseph N. Breaux

(57) ABSTRACT

A moving pin archery sight that includes a distance to target indicator/selector mechanism that allows a user to select a distance to target that corresponds with a predicted distance to a target. The distance to target indicator/selector includes a mechanism for generating a slight sound each time the indicator/selector is moved one increment. In one embodiment, the distance to target indicator/selector includes multiple, user selectable scales to allow for a number of different sized incremental distance changes to be made.

5 Claims, 8 Drawing Sheets

FIG.5
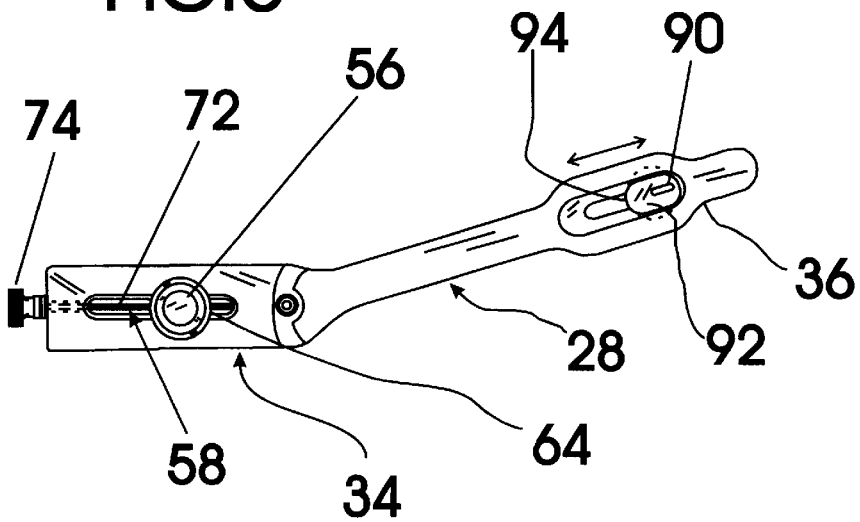
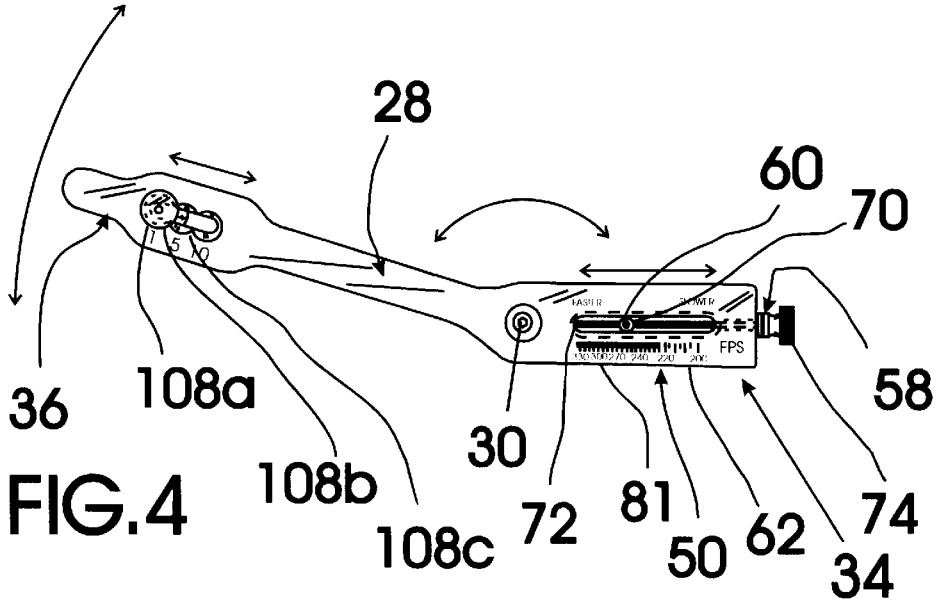
FIG.4

40-Yard Conversion Table

| Distance shot from | Actual Feet Per Second |
|---|---|
| 26 yards | 195fps |
| 27 yards | 203fps |
| 28 yards | 210fps |
| 29 yards | 218fps |
| 30 yards | 225fps |
| 31 yards | 233fps |
| 32 yards | 240fps |
| 33 yards | 248fps |
| 34 yards | 255fps |
| 35 yards | 262fps |
| 36 yards | 270fps |
| 37 yards | 278fps |
| 38 yards | 285fps |
| 39 yards | 292fps |
| 40 yards | 300fps |
| 41 yards | 308fps |
| 42 yards | 314fps |
| 43 yards | 323fps |

FIG.6

50-Yard Conversion Table

| Distance shot from | Actual Feet Per Second |
|---|---|
| 33 yards | 198fps |
| 34 yards | 204fps |
| 35 yards | 209fps |
| 36 yards | 216fps |
| 37 yards | 222fps |
| 38 yards | 228fps |
| 39 yards | 234fps |
| 40 yards | 240fps |
| 41 yards | 246fps |
| 42 yards | 252fps |
| 43 yards | 258fps |
| 44 yards | 264fps |
| 45 yards | 270fps |
| 46 yards | 276fps |
| 47 yards | 282fps |
| 48 yards | 288fps |
| 49 yards | 294fps |
| 50 yards | 300fps |
| 51 yards | 306fps |
| 52 yards | 312fps |
| 53 yards | 318fps |
| 54 yards | 324fps |

FIG.7

60-Yard Conversion Table

| Distance shot from | Actual Feet Per Second |
|---|---|
| 39 yards | 190fps |
| 40 yards | 200fps |
| 41 yards | 205fps |
| 42 yards | 210fps |
| 43 yards | 215fps |
| 44 yards | 220fps |
| 45 yards | 225fps |
| 46 yards | 230fps |
| 47 yards | 235fps |
| 48 yards | 240fps |
| 49 yards | 245fps |
| 50 yards | 550fps |
| 51 yards | 255fps |
| 52 yards | 360fps |
| 53 yards | 365fps |
| 54 yards | 370fps |
| 55 yards | 275fps |
| 56 yards | 280fps |
| 57 yards | 285fps |
| 58 yards | 290fps |
| 59 yards | 295fps |
| 60 yards | 300fps |
| 61 yards | 305fps |
| 62 yards | 310fps |
| 63 yards | 315fps |
| 64 yards | 320fps |
| 65 yards | 325fps |

FIG.8

MOVING PIN ARCHERY SIGHT

This application claims the benefit of U.S. Provisional Application No. 60/264,405, filed Jan. 26, 2001 the entire content of which is hereby incorporated by reference in this application.

TECHNICAL FIELD

The present invention relates to moving pin archery sights having a sight pin mounted to a sight in mechanical connection with a sight pin positioning mechanism that includes a positioning mechanism frame securable to an archery bow, a sight holder slide that is movable upward and downward along a predefined vertical trackway of the positioning mechanism frame, a pivoting, sight holder slide positioning arm pivotally connected at a pivot point to the positioning mechanism frame and mechanically linked along a slide connecting end portion thereof to the sight holder slide such that, as a user adjustment end of the pivoting sight holder slide positioning arm moves along an arcuate path in a substantially first direction, the sight holder slide moves along a straight path in a second direction substantially opposite the first direction, the pivot point being between the user adjustment end and the slide connecting end portion; the sight being carried on the sight holding slide; each angular position of the user adjustment end of the pivoting sight holder slide positioning arm indicating a different distance to a target such that a user may adjust the position of the sight pin of the sight to correspond with a particular distance to a target by moving the user adjustment end of the pivoting sight holder slide positioning arm to the particular angular position corresponding with the particular distance to the target; and more particularly to a moving pin archery sight that includes a ratio adjustment mechanism for allowing a user to varying the ratio of movement between the user adjustment end of the sight holder slide positioning arm and the sight holder slide to mechanically compensate the moving pin archery sight for use with particular arrow speeds generated by particular bow and arrow combinations and/or different arrows with the same bow and/or a distance to target indicator/selector mechanism that allows a user to select a distance to target that corresponds with a predicted distance to a target.

BACKGROUND ART

Moving pin archery sights allow the archer to move the sight pin to compensate for the distance to the target so that once the distance to the target is selected, the archer sights in on the target in the same manner by aligning an eyehole on the bow string, the tip of the sight pin and the target. Although moving pin archery sights allow for the repositioning of the sight pin to compensate the sight for the arrow drop expected for the distance to the target, they often do not accurately compensate the sight because the mechanical movement of the sight pin is calibrated for the flight of an arrow moving at a particular calibration arrow speed. Thus, if the arrow being shot from the bow is moving at an actual arrow speed that is either faster or slower than the calibration arrow speed, the arrow will hit the target either too high or too low, respectively. It would be desirable, therefore, to have a moving pin archery sight that included a ratio adjustment mechanism for allowing a user to varying the ratio of movement between the user adjustment end of the sight holder slide positioning arm and the sight holder slide to mechanically compensate the moving pin archery sight for use with particular arrow speeds generated by particular bow and arrow combinations and/or different arrows with the same bow. In addition, because the archer must mechanically adjust the sight to position of the sight pin for a particular distance to the target, it is often difficult for an archer who does not know what the distance to the target will be until right before the arrow is to be shot, such as while bow hunting, to adjust the sight without missing the chance for a shot at the prey. It would be a benefit, therefore, to have a moving pin bow sight that included a distance to target indicator/selector mechanism that could be rapidly adjusted to the desired target distance. Because the prey could escape when the archer averts his/her eyes to make the distance adjustment to the moving pin sight, it would be a further benefit to have a moving pin sight with a distance to target indicator/selector mechanism that emitted a slight, audible click for each increment of distance to be adjusted for so that the hunter could maintain his sight pin on the prey as the adjustment is made and release the arrow immediately after or while the distance correction is made should the prey begin to move away. Because hunting situations differ and the prey may be within shooting distance over various distance to target ranges, it would be a further benefit to have a distance to target indicator/selector mechanism which included multiple adjustment increment sets so that the hunter could select the increment set that most closely matched the current hunting conditions.

GENERAL SUMMARY DISCUSSION OF INVENTION

It is thus an object of the invention to provide an improved moving pin archery sight that includes a ratio adjustment mechanism for allowing a user to varying the ratio of movement between the user adjustment end of the sight holder slide positioning arm and the sight holder slide to mechanically compensate the moving pin archery sight for use with particular arrow speeds generated by particular bow and arrow combinations and/or different arrows with the same bow.

It is a further object of the invention to provide an improved moving pin archery sight that includes a ratio adjustment mechanism for allowing a user to varying the ratio of movement between the user adjustment end of the sight holder slide positioning arm and the sight holder slide to mechanically compensate the moving pin archery sight for use with particular arrow speeds generated by particular bow and arrow combinations and/or different arrows with the same bow wherein the ratio adjustment mechanism includes a slide bushing, a slide bushing positioning assembly, a bushing position marker, and a set of arrow speed indicator markings; the slide bushing having a first bushing end slidably entrapped along a slide bushing trackway of the sight holder slide that is oriented at a ninety degree angle to the straight path of travel of the sight holder slide and a second bushing end in connection with the slide bushing positioning assembly; the slide bushing positioning assembly being mounted to the slide connecting end portion of the sight holder slide positioning arm and operable to vary the position of the second bushing end along the slide connecting end portion of the sight holder slide positioning arm and configured to hold the second bushing end at a user set position with respect to the slide connecting end portion of the sight holder slide positioning arm; the bushing position marker being mechanically coupled to the slide bushing in a manner to change position along with the second bushing end in a fixed ratio; the set of arrow speed indicator markings being formed onto a surface adjacent the bushing position marker and parallel to the line of travel of the position marker such that the user may position the bushing position marker adjacent to a particular speed indicator marking to calibrate the ratio of movement between the user adjustment end of the sight holder slide positioning arm and the sight holder slide to the arrow speed at which an arrow shot from an archery bow to which the sight is attached leaves the archery bow; the set of arrow speed indicator markings indicating higher speeds closer to the pivot point; the distance between pairs of individual arrow speed indicator markings becoming incrementally larger as the arrow speed indicated incrementally decreases.

It is a further an object of the invention to provide an improved moving pin archery sight that includes a distance to target indicator/selector mechanism that allows a user to select a distance to target that corresponds with a predicted distance to a target.

It is a further an object of the invention to provide an improved moving pin archery sight that includes a distance to target indicator/selector mechanism that allows a user to select a distance to target that corresponds with a predicted distance to a target in a manner that generates an audible sound for each increment of distance changed.

It is a further an object of the invention to provide an improved moving pin archery sight that includes a distance to target indicator/selector mechanism that allows a user to select a distance to target that corresponds with a predicted distance to a target that allows a user to select from one of multiple distance increment scales.

It is a further an object of the invention to provide an improved moving pin archery sight that includes a distance to target indicator/selector mechanism that allows a user to select a distance to target that corresponds with a predicted distance to a target wherein the distance to target indicator/selector mechanism includes multiple sets of seating structures formed in connection with a pivoting sight holder slide positioning arm facing surface of the positioning mechanism frame and a mating structure carried on the user adjustment end of the pivoting sight holder slide positioning arm that is individually engageable with each of the seating structures and is moveable to multiple mating structure positions on the user adjustment end of the pivoting sight holder slide positioning arm and releasably securable at each of the multiple mating structure positions with a mating structure holding mechanism; each seating structure corresponding to a particular distance to target; each set of seating structures being spaced along a separate arc corresponding angularly with a substantially same angular portion of the angular travel of the user adjustment end of the pivoting sight holder slide positioning arm; each particular seating structure set of the multiple sets of seating structures having a same particular structure set gap distance between each pair of adjacent seating structures within the particular seating structure set that corresponds to an increment of distance to a target; the particular structure set gap distance of one particular seating structure set being an integer multiple of the particular structure set gap distance of another seating structure set; each of the multiple mating structure positions on the user adjustment end of the pivoting sight holder slide positioning arm corresponding with a particular seating structure set of the multiple sets of seating structures such that the mating structure is restricted to engaging only with seating structures of the corresponding particular seating structure set; the mating structure being moveable between separate seating structures of a particular seating structure set by deflecting the user adjustment end of the pivoting sight holder slide positioning arm sufficiently to disengage the mating structure from engaged relationship with a seating structure, angularly moving the deflected user adjustment end of the pivoting sight holder slide positioning arm such that the mating structure is positioned adjacent the selected seating structure, and then releasing the deflected user adjustment end of the pivoting sight holder slide positioning arm to allow the mating structure to engage the selected seating structure; the seating structures and the mating structure being shaped and sized such that a user may generate the deflecting force by pushing the user adjustment end of the pivoting sight holder slide positioning arm clockwise or counter-clockwise such that an engaged seating structure and the mating structure generate a deflecting force sufficient to cause the mating structure to disengage from the engaged seating structure, slide along the pivoting sight holder slide positioning arm facing surface of the positioning mechanism frame and engage an adjacent seating structure in a manner to generate a click sound audible to an archer such that the archer may determine the number of incremental changes being made by the number of audible clicks heard without removing his/her eye from the target.

It is a still further object of the invention to provide an improved moving pin bow sight that accomplishes some or all of the of the above objects in combination.

Accordingly, an improved moving pin archery sight is provided. In one embodiment the improvement to the moving pin archery sight as described includes the addition of a moving pin archery sight that includes a ratio adjustment mechanism for allowing a user to varying the ratio of movement between the user adjustment end of the sight holder slide positioning arm and the sight holder slide to mechanically compensate the moving pin archery sight for use with particular arrow speeds generated by particular bow and arrow combinations and/or different arrows with the same bow and/or a distance to target indicator/selector mechanism that allows a user to select a distance to target that corresponds with a predicted distance to a target; the ratio adjustment mechanism including a slide bushing, a slide bushing positioning assembly, a bushing position marker, and a set of arrow speed indicator markings; the slide bushing having a first bushing end slidably entrapped along a slide bushing trackway of the sight holder slide that is oriented at a ninety degree angle to the straight path of travel of the sight holder slide and a second bushing end in connection with the slide bushing positioning assembly; the slide bushing positioning assembly being mounted to the slide connecting end portion of the sight holder slide positioning arm and operable to vary the position of the second bushing end along the slide connecting end portion of the sight holder slide positioning arm and configured to hold the second bushing end at a user set position with respect to the slide connecting end portion of the sight holder slide positioning arm; the bushing position marker being mechanically coupled to the slide bushing in a manner to change position along with the second bushing end in a fixed ratio; the set of arrow speed indicator markings being formed onto a surface adjacent the bushing position marker and parallel to the line of travel of the position marker such that the user may position the bushing position marker adjacent to a particular speed indicator marking to calibrate the ratio of movement between the user adjustment end of the sight holder slide positioning arm and the sight holder slide to the arrow speed at which an arrow shot from an archery bow to which the sight is attached leaves the archery bow; the set of arrow speed indicator markings indicating higher speeds closer to the pivot point; the distance between pairs of individual arrow speed indicator markings becoming incrementally larger as the arrow speed indicated incrementally decreases.

In another embodiment, the improvement to the moving pin sight includes the addition of a distance to target indicator/selector mechanism that allows a user to select a distance to target that corresponds with a predicted distance to a target; the distance to target indicator/selector mechanism including multiple sets of seating structures formed in connection with a pivoting sight holder slide positioning arm facing surface of the positioning mechanism frame and a mating structure carried on the user adjustment end of the pivoting sight holder slide positioning arm that is individually engageable with each of the seating structures and is moveable to multiple mating structure positions on the user adjustment end of the pivoting sight holder slide positioning arm and releasably securable at each of the multiple mating structure positions with a mating structure holding mechanism; each seating structure corresponding to a particular distance to target; each set of seating structures being spaced along a separate arc corresponding angularly with a substantially same angular portion of the angular travel of the user adjustment end of the pivoting sight holder slide positioning arm; each particular seating structure set of the multiple sets of seating structures having a same particular structure set gap distance between each pair of adjacent seating structures within the particular seating structure set that corresponds to an increment of distance to a target; the particular structure set gap distance of one particular seating structure set being an integer multiple of the particular structure set gap distance of another seating structure set; each of the multiple mating structure positions on the user adjustment end of the pivoting sight holder slide positioning arm corresponding with a particular seating structure set of the multiple sets of seating structures such that the mating structure is restricted to engaging only with seating structures of the corresponding particular seating structure set; the mating structure being moveable between separate seating structures of a particular seating structure set by deflecting the user adjustment end of the pivoting sight holder slide positioning arm sufficiently to disengage the mating structure from engaged relationship with a seating structure, angularly moving the deflected user adjustment end of the pivoting sight holder slide positioning arm such that the mating structure is positioned adjacent the selected seating structure, and then releasing the deflected user adjustment end of the pivoting sight holder slide positioning arm to allow the mating structure to engage the selected seating structure; the seating structures and the mating structure being shaped and sized such that a user may generate the deflecting force by pushing the user adjustment end of the pivoting sight holder slide positioning arm clockwise or counter-clockwise such that an engaged seating structure and the mating structure generate a deflecting force sufficient to cause the mating structure to disengage from the engaged seating structure, slide along the pivoting sight holder slide positioning arm facing surface of the positioning mechanism frame and engage an adjacent seating structure in a manner to generate a click sound audible to an archer such that the archer may determine the number of incremental changes being made by the number of audible clicks heard without removing his/her eye from the target.

In yet another embodiment the improvement to the moving pin sight includes the addition of a moving pin archery sight that includes a ratio adjustment mechanism for allowing a user to varying the ratio of movement between the user adjustment end of the sight holder slide positioning arm and the sight holder slide to mechanically compensate the moving pin archery sight for use with particular arrow speeds generated by particular bow and arrow combinations and/or different arrows with the same bow and the addition of a distance to target indicator/selector mechanism that allows a user to select a distance to target that corresponds with a predicted distance to a target; the ratio adjustment mechanism including a slide bushing, a slide bushing positioning assembly, a bushing position marker, and a set of arrow speed indicator markings; the slide bushing having a first bushing end slidably entrapped along a slide bushing trackway of the sight holder slide that is oriented at a ninety degree angle to the straight path of travel of the sight holder slide and a second bushing end in connection with the slide bushing positioning assembly; the slide bushing positioning assembly being mounted to the slide connecting end portion of the sight holder slide positioning arm and operable to vary the position of the second bushing end along the slide connecting end portion of the sight holder slide positioning arm and configured to hold the second bushing end at a user set position with respect to the slide connecting end portion of the sight holder slide positioning arm; the bushing position marker being mechanically coupled to the slide bushing in a manner to change position along with the second bushing end in a fixed ratio; the set of arrow speed indicator markings being formed onto a surface adjacent the bushing position marker and parallel to the line of travel of the position marker such that the user may position the bushing position marker adjacent to a particular speed indicator marking to calibrate the ratio of movement between the user adjustment end of the sight holder slide positioning arm and the sight holder slide to the arrow speed at which an arrow shot from an archery bow to which the sight is attached leaves the archery bow; the set of arrow speed indicator markings indicating higher speeds closer to the pivot point; the distance between pairs of individual arrow speed indicator markings becoming incrementally larger as the arrow speed indicated incrementally decreases; the distance to target indicator/selector mechanism including multiple sets of seating structures formed in connection with a pivoting sight holder slide positioning arm facing surface of the positioning mechanism frame and a mating structure carried on the user adjustment end of the pivoting sight holder slide positioning arm that is individually engageable with each of the seating structures and is moveable to multiple mating structure positions on the user adjustment end of the pivoting sight holder slide positioning arm and releasably securable at each of the multiple mating structure positions with a mating structure holding mechanism; each seating structure corresponding to a particular distance to target; each set of seating structures being spaced along a separate arc corresponding angularly with a substantially same angular portion of the angular travel of the user adjustment end of the pivoting sight holder slide positioning arm; each particular seating structure set of the multiple sets of seating structures having a same particular structure set gap distance between each pair of adjacent seating structures within the particular seating structure set that corresponds to an increment of distance to a target; the particular structure set gap distance of one particular seating structure set being an integer multiple of the particular structure set gap distance of another seating structure set; each of the multiple mating structure positions on the user adjustment end of the pivoting sight holder slide positioning arm corresponding with a particular seating structure set of the multiple sets of seating structures such that the mating structure is restricted to engaging only with seating structures of the corresponding particular seating structure set; the mating structure being moveable between separate seating structures of a particular seating structure set by deflecting the user adjustment end of the pivoting sight holder slide positioning arm sufficiently to disengage the mating structure from engaged relationship with a seating structure, angularly moving the deflected user adjustment end of the pivoting sight holder slide positioning arm such that the mating structure is positioned adjacent the selected seating structure, and then releasing the deflected user adjustment end of the pivoting sight holder slide positioning arm to allow the mating structure to engage the selected seating structure; the seating structures and the mating structure being shaped and sized such that a user may generate the deflecting force by pushing the user adjustment end of the pivoting sight holder slide positioning arm clockwise or counter-clockwise such that an engaged seating structure and the mating structure generate a deflecting force sufficient to cause the mating structure to disengage from the engaged seating structure, slide along the pivoting sight holder slide positioning arm facing surface of the positioning mechanism frame and engage an adjacent seating structure in a manner to generate a click sound audible to an archer such that the archer may determine the number of incremental changes being made by the number of audible clicks heard without removing his/her eye from the target.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 4 is a side plan view of the outwardly facing surface of the sight holder slide positioning arm of the exemplary improved moving pin sight of FIG. 1 in isolation showing the positioning arm pivot screw positioned through the pivot aperture of the sight holder slide positioning arm at a point between the user adjustment end of the pivoting sight holder slide positioning arm and the slide connecting end portion of the sight holder slide positioning arm; a portion of the ratio adjustment mechanism provided on the slide connecting end portion of the sight holder slide positioning arm including the knurled knob on the end of the positioning screw of slide bushing positioning assembly, the bushing position marker carried on the positioning screw connecting end of the slide bushing, the positioning screw connecting end being threaded onto and positioned by rotation of the positioning screw and the set of arrow speed indicator markings positioned along the length of a bushing position marker viewing aperture formed trough the outwardly facing surface of the slide connecting end portion of the sight holder slide positioning arm; and a portion of the mating structure carried on the user adjustment end of the pivoting sight holder slide positioning arm releasably secured in position to engage the outermost of the three sets of oblong curved sided, seating structure cavities provided in this embodiment by the knurled securing nut member threaded onto the threaded rod extending out of a backside of the mating structure member.

FIG. 5 is a side plan view of the positioning mechanism frame facing surface of the sight holder slide positioning arm of the exemplary improved moving pin sight of FIG. 1 in isolation showing the positioning arm pivot screw positioned through the pivot aperture of the sight holder slide positioning arm at a point between the user adjustment end of the pivoting sight holder slide positioning arm and the slide connecting end portion of the sight holder slide positioning arm; a portion of the ratio adjustment mechanism provided on the slide connecting end portion of the sight holder slide positioning arm including the slide bushing slidably positioned on the positioning mechanism frame facing surface of the slide connecting end portion of the sight holder slide positioning arm, movably linearly along by rotation of the knurled knob on the end of the positioning screw and sized fit into and substantially playlessslly, slidably travel along the slide bushing trackway of the sight holder slide; and the positioning mechanism frame facing surface of the mating structure member having the oblong, curve sided, mating structure extending outwardly therefrom that is sized to at least partially seat into and releasably engage each of the oblong curved sided, seating structure cavities provided in this embodiment.

FIG. 6 is a 40 yard conversion table that is provided for use when calibrating the improved moving pin archer sight of FIG. 1 for use with a particular bow and arrow combination.

FIG. 7 is a 50 yard conversion table that is provided for use when calibrating the improved moving pin archer sight of FIG. 1 for use with a particular bow and arrow combination.

FIG. 8 is a 60 yard conversion table that is provided for use when calibrating the improved moving pin archer sight of FIG. 1 for use with a particular bow and arrow combination.

EXEMPLARY MODE FOR CARRYING OUT THE INVENTION

Figure 1:
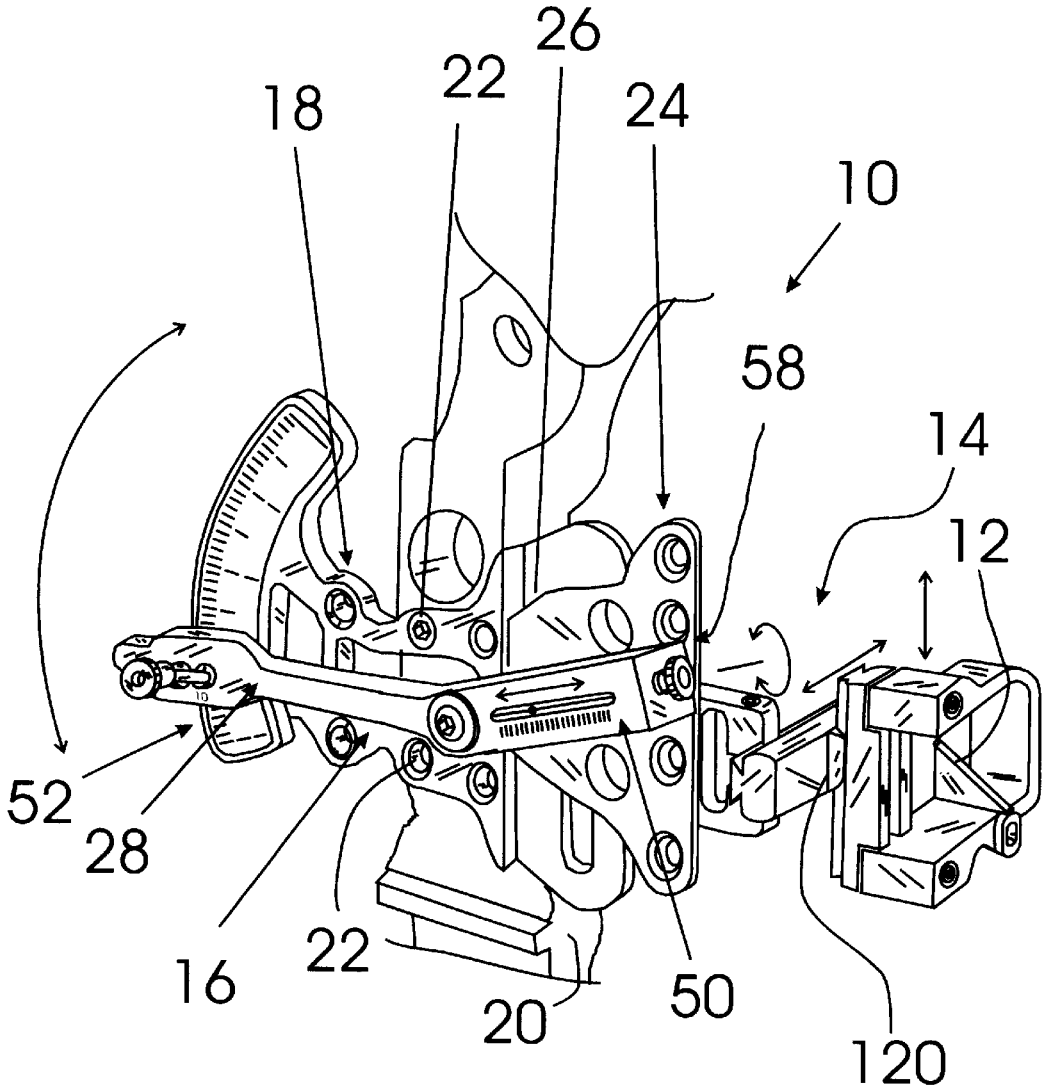
FIG. 1 is a perspective view of an exemplary embodiment of the improved moving pin archery sight of the present invention.
Figure 2:
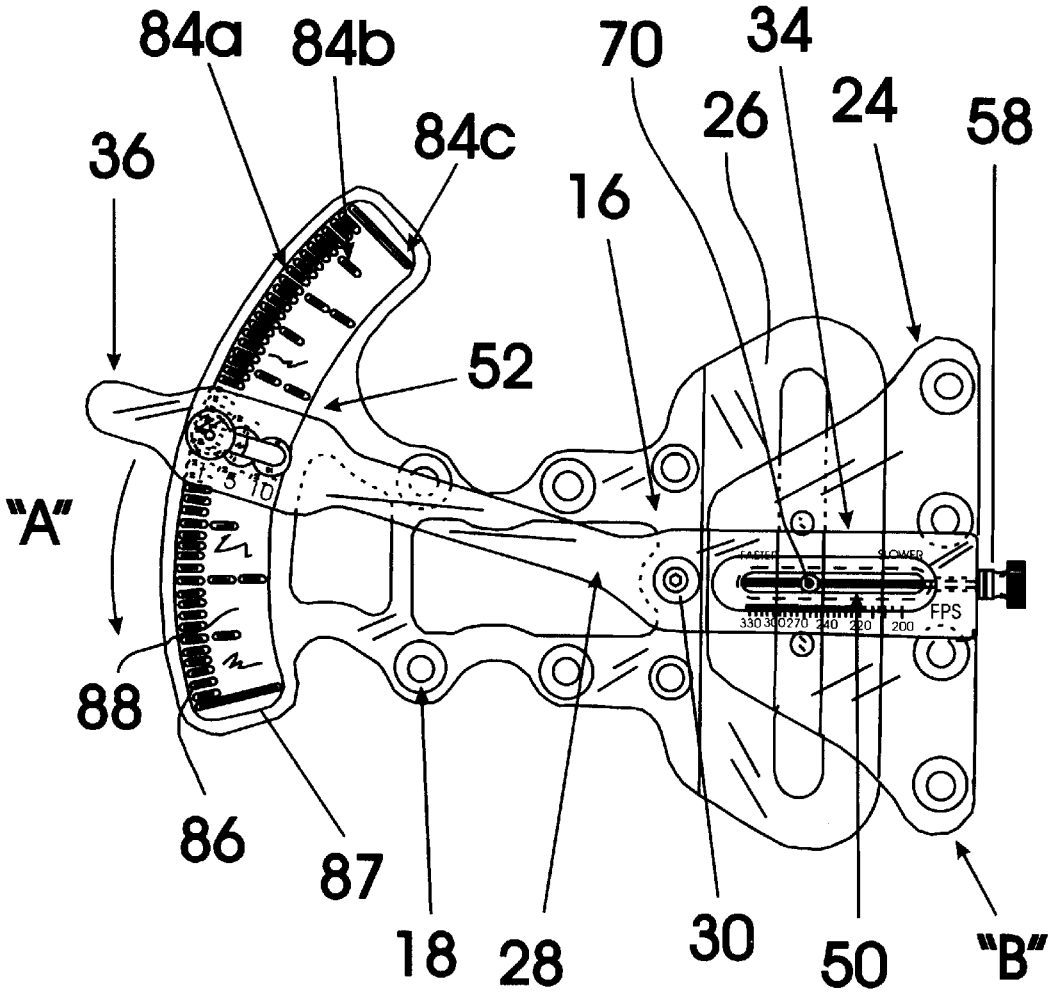
FIG. 2 is a side plan view of the improved moving pin archery sight view of the improved moving pin archery sight of FIG. 1 with the sight assembly detached from the sight holder slide and the with the mating structure releasably secured in position to engage the outermost of the three sets of oblong curved sided, seating structure cavities provided in this embodiment by the knurled securing nut member.
Figure 3:
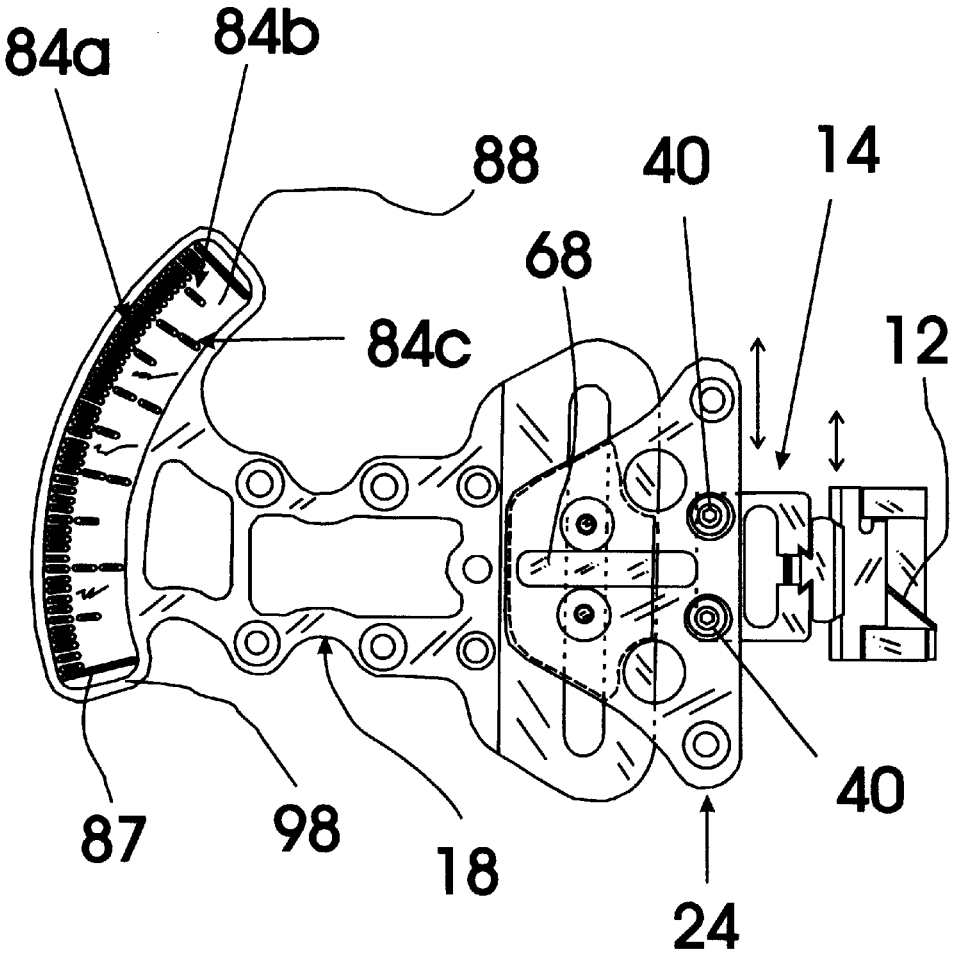
FIG. 3 is a side plan view of the improved moving pin archery sight of FIG. 1 with the pivoting sight holders slide positioning arm removed to show the internally threaded, pivot screw attachment aperture and the sight holder slide slidably entrapped to slide along a straight path defined by the straight, oblong sight holder aperture formed in the positioning mechanism frame by two slide attachment screw/bushing sets positioned through the oblong sight holder aperture and threaded into the two internally threaded slide attachment screw apertures formed in the sight holder slide; the sight holder slide having a slide bushing trackway formed through the sight holder slide that is oriented at a ninety degree angle to the straight oblong sight holder aperture of the positioning mechanism frame.
Figure 3A:
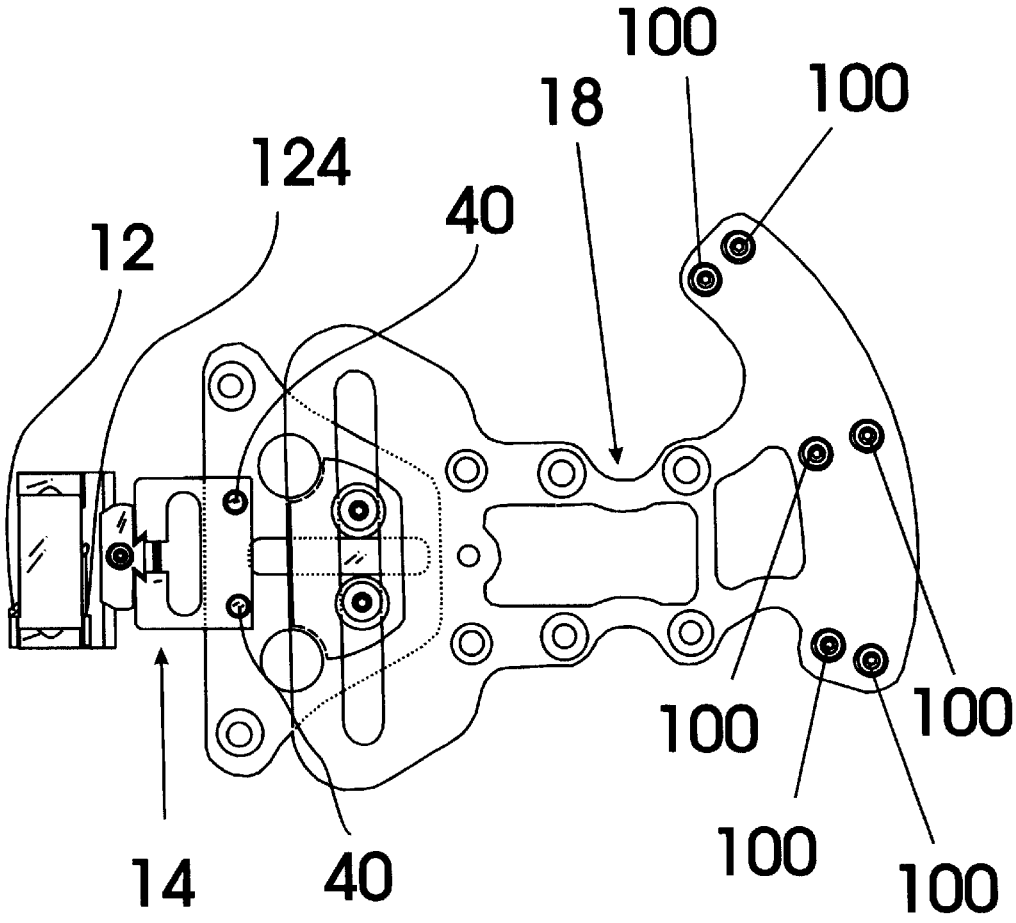
FIG. 3A is a side plan view of the improved moving pin archery sight of FIG. 1 with the pivoting sight holders slide positioning arm removed from the opposite side shown in FIG. 3 showing the internally threaded, pivot screw attachment aperture and the sight holder slide slidably entrapped to slide along a straight path defined by the straight, oblong sight holder aperture formed in the positioning mechanism frame by two slide attachment screw/bushing sets positioned through the oblong sight holder aperture; the sight holder slide having a slide bushing trackway formed through the sight holder slide that is oriented at a ninety degree angle to the straight oblong sight holder aperture of the positioning mechanism frame; the sight assembly being attached to the sight holder slide with two sight assembly attachment screws.

FIGS. 1–8 and 3A illustrate various aspects of an exemplary embodiment of the improved moving pin archery sight of the present invention, generally designated 10. Improved moving pin archery sight 10 includes a sight pin 12 mounted to a sight, generally designated 14 in mechanical connection with a sight pin positioning mechanism, generally designated 16, that includes a positioning mechanism frame, generally designated 18, securable to an archery bow 20 with screws 22; a sight holder slide, generally designated 24, that is movable upward and downward along a predefined vertical trackway 26 of positioning mechanism frame 16; a pivoting, sight holder slide positioning arm, generally designated 28, pivotally connected at a pivot point 30 to positioning mechanism frame with a pivot screw 32 and mechanically linked along a slide connecting end portion thereof, generally designated 34, to sight holder slide 24 such that, as a user adjustment end, generally designated 36, of pivoting sight holder slide positioning arm 28 moves along an arcuate path in a substantially first direction "A", sight holder slide 24 moves along a straight path "B" in a second direction substantially opposite the first direction "A". Pivot point 30 lies between user adjustment end 36 and slide connecting end portion 34. Sight 14 is carried on sight holding slide 24 and is attached thereto with two screws 40.

According to the mechanical construction of moving pin sight 10, each angular position of user adjustment end 36 of pivoting sight holder slide positioning arm 28 indicates a different distance to a target such that a user may adjust the position of sight pin 12 of sight 14 to correspond with a particular distance to a target by moving user adjustment end 36 of pivoting sight holder slide positioning arm 28 to the particular angular position corresponding with the particular distance to the target.

In this embodiment, the improvements to moving pin sight 10 include the addition of a ratio adjustment mechanism, generally designated 50, and a distance to target indicator/selector, generally designated 52. Ratio adjustment mechanism 50 is provided for allowing a user to varying the ratio of movement between user adjustment end 36 of sight holder slide positioning arm 28 and sight holder slide 24 to mechanically compensate the moving pin archery sight 10 for use with particular arrow speeds generated by particular bow and arrow combinations and/or different arrows with the same bow. Distance to target indicator/selector mechanism 52 is provides the user with three user selectable sets of adjustment increments and also allows the user to verify that the distance to target setting has been adjusted both visually and audibly by counting the audible clicks generated by the distance to target indicator/selector mechanism 52 as the user adjustment end 36 of the sight holder slide positioning arm 28 moved from a known distance to target location to the desired distance to target location.

In this exemplary embodiment ratio adjustment mechanism 50 includes a slide bushing, generally designated 56; a slide bushing positioning assembly, generally designated 58; a bushing position marker 60; and a set of arrow speed indicator markings, generally designated 62. Slide bushing 56 has a first bushing end 64 slidably entrapped along a slide bushing trackway 68 of sight holder slide 24 that is oriented at a ninety degree angle to the straight path of travel 26 of sight holder slide 24 and a second bushing end 70 threaded onto a positioning screw 72 of slide bushing positioning assembly 58 that is rotatable by a user by grasping and turning a connected adjustment knob 74 to position bushing marker 60 at the desired setting indicated with respect to the set of arrow speed indicator markings 62. Slide bushing positioning assembly 58 is mounted to slide connecting end portion 34 of sight holder slide positioning arm 28 and is operable to allow the user to vary the position of second bushing end 64 along slide connecting end portion 34 of sight holder slide positioning arm 28 and is configured to hold second bushing end 64 at the user set position with respect to slide connecting end portion 34 until positioning screw 72 is rotated by the user. Bushing position marker 60 rides on slide bushing 56 in a manner to change position along with the second bushing end 70 in a fixed 1 to 1 ratio. The set of arrow speed indicator markings 62 are formed onto a surface of slide connecting end portion 34 adjacent to bushing position marker 60 and parallel to the line of travel of position marker 60 along positioning screw 72 such that the user may position the bushing position marker 60 adjacent to a particular speed indicator marking 81 to calibrate the ratio of movement between the user adjustment end 36 of sight holder slide positioning arm 28 and sight holder slide 24 to the arrow speed at which a particular arrow, shot from the archery bow 20 to which moving pin sight 10 is attached, leaves the archery bow 20. The set of arrow speed indicator markings 62 indicate higher arrow speeds closer to the pivot point of sight holder slide positioning arm 28. The distance between pairs of individual arrow speed indicator markings 81 become incrementally larger as the arrow speed indicated by the individual arrow speed indicator markings 81 incrementally decreases. In this embodiment, the distance between the arrow speed indicator mark 81 for an arrow speed of 330 ft/sec and the arrow speed indicator mark 81 for an arrow speed of 330 ft/sec is about 0.15"; the distance between the arrow speed indicator mark 81 for an arrow speed of 300 ft/sec and the arrow speed indicator mark 81 for an arrow speed of 270 ft/sec is about 0.18"; the distance between the arrow speed indicator mark 81 for an arrow speed of 270 ft/sec and the arrow speed indicator mark 81 for an arrow speed of 240 ft/sec is about 0.28"; and the distance between the arrow speed indicator mark 81 for an arrow speed of 240 ft/sec and the arrow speed indicator mark 81 for an arrow speed of 220 ft/sec is about 0.39". This varying distance between arrow speed indicators occurs because at a level trajectory, (disregarding other variables such as wind direction and speed, the physical characteristics of the arrow head and flights of the arrow, and similar considerations), the arrow drops a distance "D" during the time it is in flight that is proportional to the square of the flight time between the release of the arrow and when it strikes the target. The distance "D" is calculated classically by the equation $D=at^2$ where "a" is the acceleration caused by gravity or 32 $ft/s^2$ and t is the flight time. The particular distances between particular pairs of arrow speed indicator marks 81 is also a function of the physical size of the sight 10 and the various physical mechanical interrelationships between the parts of the particular sight pin positioning mechanism of a particular moving pin sight to which the improvements of the present invention are adapted.

The moving pin sight 10 may be calibrated for a particular arrow speed using bow 20 and a particular arrow by adjusting the position of the bushing position marker 60 until the shot arrows are hitting the target at two predetermined distances. The two furthest distances that can be shot by the archer will yield the most accurate setting of the bushing position marker 60 and the most accurate arrow speed calibration of sight 10 for a particular arrow and bow. The archer can then read the arrow speed adjacent to the bushing position marker 60 from the set of arrow speed indicator markings 62.

The pin sight 10 may also be calibrated for a particular arrow speed using the conversion tables of FIGS. 6,7 and 8. When the sight 10 is to be calibrated with the conversion tables, the archer should measure from the target out to 60 yards on a near level surface and make marks every five yards. The speed indicator should then be set to 300 ft/sec and the distance to target indicator/selector 52 positioned at the 20 yard position. The archer should then shoot arrows at the target from the twenty yard mark and adjust only the sight 14 using a vertical sight adjustment 120 provided on sight 14 to raise or lower the tip end 124 of sight pin 12 until the archer consistently hits the target at the aimed target spot. Do not move the distance to target indicator/selector 52 from the 20 yard position until this adjustment is made.

The archer should then move the distance to target indicator/selector 52 to the 60 yard mark (or the farthest of the 50 and 40 yard marks if the archer cannot shoot accurately from 60 yards). The archer should then move to the 60 yard spot (or the respective 50 or 40 yard spot) and shoot arrows at the target moving toward or away from the target until the archer consistently hits the targeted spot. The archer should then measure the spot from which he/she is shooting accurately, look up the spot distance on the appropriate conversion chart and read off the arrow speed positioned next to the spot distance. The archer should then calibrate the sight by positioning the bushing position marker 60 adjacent to the arrow speed indicator marking 81 that corresponds with the arrow speed read off the conversion chart.

In this embodiment, the distance to target indicator/selector mechanism 52 includes multiple sets, generally designated 84*a*,84*b*,84*c*, of oblong, curved-sided, seating structure cavities 86 formed into a pivoting sight holder slide positioning arm facing surface 88 of positioning mechanism frame 18 and an oblong, curve-sided, mating structure 90 extending outwardly from a positioning mechanism frame facing surface 92 of a mating structure member 94 that is carried on the user adjustment end 36 of pivoting sight holder slide positioning arm 28. In this embodiment, oblong, curved-sided, seating structure cavities 86 are molded into a molded plastic insert 87 secured into a correspondingly shaped cavity 98 of positioning mechanism frame 18 and held in place with screws 100. Mating structure member 94 is also molded from plastic. Oblong, curve sided, mating structure 90 is shaped and sized to at least partially seat into and releasably engage each of the oblong curved sided, seating structure cavities 86 provided in this embodiment.

Mating structure member 94 is moveably positionable and securable in each of three securing positions 108*a*,108*b*, 108*c* that are selected such that, when mating structure member 94 is secured in one of the three securing positions 108*a*,108*b*,108*c*, the oblong, curve sided, mating structure 90 moves over and is engageable with a corresponding set 84*a*,84*b*,84*c*, of oblong, curved-sided, seating structure cavities 86. The gap distances between the seating structure cavities 86 of set 84*a* are equivalent to one unit of distance, (such as a yard or a meter); the gap distances between the seating structure cavities 86 of set 84*b* are equivalent to five of the same units of distance used by set 84*a*; and the gap distances between the seating structure cavities 86 of set 84*c* are equivalent to ten of the same units of distance used by set 84*a*. The relative sizes and orientations of the user adjustment end 36 of pivoting sight holder slide positioning arm 28, the oblong, curved-sided, seating structure cavities 86, the surface of the molded plastic insert 87, and the oblong, curve sided, mating structure 90 are selected such that the mating structure 90 is moveable between separate seating structure cavities 86 by two methods.

In the first method, the user moves the mating structure 90 between separate seating structure cavities 86 by pushing user adjustment end 36 of pivoting sight holder slide positioning arm 28 in a direction away from the surface of the molded plastic insert 87, and the oblong, curved-sided, seating structure cavity 86 being moved away from until mating structure 90 is free to move over the surface of the molded plastic insert 87 without contacting. The user then positions mating structure 90 over the desired the selected seating structure cavity 86 by pivoting user adjustment end 36 of pivoting sight holder slide positioning arm 28 while it is still deflected. Pivoting user adjustment end 36 of pivoting sight holder slide positioning arm 28 is then released and mating structure 90 engages the selected seating structure cavity 86.

In the second method, the user simply pushes user adjustment end 36 of pivoting sight holder slide positioning arm 28 in the direction toward the desired seating structure cavity, because the sides of both the mating structure 90 and the seating structure cavities 86 are curved, pushing on user adjustment end 36 of pivoting sight holder slide positioning arm 28 in the manner described causes the curved surfaces of the mating structure 90 and the particular seating structure cavity 86 with which it is currently engaged act against each other to deflect the user adjustment end 36 of pivoting sight holder slide positioning arm 28 sufficiently to allow mating structure 90 to disengage from the particular seating structure cavity 86 with which it is currently engaged slide over the surface of plastic molded insert 87 and then snap into the adjacent seating structure cavity 86 in a manner that generates a slightly audible click sound. In this manner the archer can move the mating structure 90 from engagement with a known particular seating structure cavity 86 to a desired selected seating structure cavity 86 by knowing which set 84*a*,84*b*,84*c*, of oblong, curved-sided, seating structure cavities 86 is being used and by counting the audible clicks until the desired seating structure cavity 86 is reached. This second method allows the archer to maintain his/her sight pin on the prey or target and release the arrow immediately after the adjustment is made or during the adjustment if the prey begins to move out of range. It can be seen from the preceding description that an improved moving pin archery sight has been provided.

It is noted that the embodiment of the improved moving pin archery sight described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. In a moving pin archery sights having a sight pin mounted to a sight in mechanical connection with a sight pin positioning mechanism that includes a positioning mechanism frame securable to an archery bow, a sight holder slide that is movable upward and downward along a predefined vertical trackway of the positioning mechanism frame, a pivoting, sight holder slide positioning arm pivotally connected at a pivot point to the positioning mechanism frame and mechanically linked along a slide connecting end portion thereof to the sight holder slide such that, as a user adjustment end of the pivoting sight holder slide positioning arm moves along an arcuate path in a substantially first direction, the sight holder slide moves along a straight path in a second direction substantially opposite the first direction, the pivot point being between the user adjustment end and the slide connecting end portion; the sight being carried on the sight holding slide; each angular position of the user adjustment end of the pivoting sight holder slide positioning arm indicating a different distance to a target such that a user may adjust the position of the sight pin of the sight to correspond with a particular distance to a target by moving the user adjustment end of the pivoting sight holder slide positioning arm to the particular angular position corresponding with the particular distance to the target; the improvement comprising:

a distance to target indicator/selector mechanism comprising:

a set of seating structures formed in connection with a pivoting sight holder slide positioning arm facing surface of the positioning mechanism frame and a mating structure carried on the user adjustment end of the pivoting sight holder slide positioning arm that is individually engageable with each of the seating structures;

each seating structure corresponding to a particular distance to target;

the set of seating structures being spaced along an arc corresponding angularly with a substantially same angular portion of the angular travel of the user adjustment end of the pivoting sight holder slide positioning arm;

the seating structure set having a same structure set gap distance between each pair of adjacent seating structures that corresponds to an increment of distance to a target;

the mating structure being moveable between separate seating structures of a particular seating structure set by deflecting the user adjustment end of the pivoting sight holder slide positioning arm sufficiently to disengage the mating structure from engaged relationship with a seating structure, angularly moving the deflected user adjustment end of the pivoting sight holder slide positioning arm such that the mating structure is positioned adjacent the selected seating structure, and then releasing the deflected user adjustment end of the pivoting sight holder slide positioning arm to allow the mating structure to engage the selected seating structure;

the seating structures and the mating structure being shaped and sized such that a user may generate the deflecting force by pushing the user adjustment end of the pivoting sight holder slide positioning arm clockwise or counter-clockwise such that an engaged seating structure and the mating structure generate a deflecting force sufficient to cause the mating structure to disengage from the engaged seating structure, slide along the pivoting sight holder slide positioning arm facing surface of the positioning mechanism frame and engage an adjacent seating structure.

2. The improved moving pin archery sight of claim 1 wherein:

when the mating structure disengages from the engaged seating structure, slides along the pivoting sight holder slide positioning arm facing surface of the positioning mechanism frame and engages an adjacent seating structure, the mating structure engages the adjacent seating structure in a manner to generate a click sound audible to an archer such that the archer may determine the number of incremental changes being made by the number of audible clicks heard without removing his/her eye from a target.

3. In a moving pin archery sights having a sight pin mounted to a sight in mechanical connection with a sight pin positioning mechanism that includes a positioning mechanism frame securable to an archery bow, a sight holder slide that is movable upward and downward along a predefined vertical trackway of the positioning mechanism frame, a pivoting, sight holder slide positioning arm pivotally connected at a pivot point to the positioning mechanism frame and mechanically linked along a slide connecting end portion thereof to the sight holder slide such that, as a user adjustment end of the pivoting sight holder slide positioning arm moves along an arcuate path in a substantially first direction, the sight holder slide moves along a straight path in a second direction substantially opposite the first direction, the pivot point being between the user adjustment end and the slide connecting end portion; the sight being carried on the sight holding slide; each angular position of the user adjustment end of the pivoting sight holder slide positioning arm indicating a different distance to a target such that a user may adjust the position of the sight pin of the sight to correspond with a particular distance to a target by moving the user adjustment end of the pivoting sight holder slide positioning arm to the particular angular position corresponding with the particular distance to the target; the improvement comprising:

the distance to target indicator/selector mechanism includes multiple sets of seating structures formed in connection with a pivoting sight holder slide positioning arm facing surface of the positioning mechanism frame and a mating structure carried on the user adjustment end of the pivoting sight holder slide positioning arm that is individually engageable with each of the seating structures and is moveable to multiple mating structure positions on the user adjustment end of the pivoting sight holder slide positioning arm and releasably securable at each of the multiple mating structure positions with a mating structure holding mechanism;

each seating structure corresponding to a particular distance to target;

each set of seating structures being spaced along a separate arc corresponding angularly with a substantially same angular portion of the angular travel of the user adjustment end of the pivoting sight holder slide positioning arm;

each particular seating structure set of the multiple sets of seating structures having a same particular structure set gap distance between each pair of adjacent seating structures within the particular seating structure set that corresponds to an increment of distance to a target;

the particular structure set gap distance of one particular seating structure set being an integer multiple of the particular structure set gap distance of another seating structure set;

each of the multiple mating structure positions on the user adjustment end of the pivoting sight holder slide positioning arm corresponding with a particular seating structure set of the multiple sets of seating structures such that the mating structure is restricted to engaging only with seating structures of the corresponding particular seating structure set;

the mating structure being moveable between separate seating structures of a particular seating structure set by deflecting the user adjustment end of the pivoting sight holder slide positioning arm sufficiently to disengage the mating structure from engaged relationship with a seating structure, angularly moving the deflected user adjustment end of the pivoting sight holder slide positioning arm such that the mating structure is positioned adjacent the selected seating structure, and then releasing the deflected user adjustment end of the pivoting sight holder slide positioning arm to allow the mating structure to engage the selected seating structure.

4. The improved moving pin archery sight of claim 3 wherein:

the seating structures and the mating structure are shaped and sized such that a user may generate the deflecting force by pushing the user adjustment end of the pivoting sight holder slide positioning arm clockwise or counter-clockwise such that an engaged seating structure and the mating structure generate a deflecting force sufficient to cause the mating structure to disengage from the engaged seating structure, slide along the pivoting sight holder slide positioning arm facing surface of the positioning mechanism frame and engage an adjacent seating structure.

5. The improved moving pin archery sight of claim 4 wherein:

when the mating structure disengages from the engaged seating structure, slides along the pivoting sight holder slide positioning arm facing surface of the positioning mechanism frame and engages an adjacent seating structure, the mating structure engages the adjacent seating structure in a manner to generate a click sound audible to an archer such that the archer may determine the number of incremental changes being made by the number of audible clicks heard without removing his/her eye from a target.

* * * * *